US010865973B2

(12) United States Patent
Gielen et al.

(10) Patent No.: US 10,865,973 B2
(45) Date of Patent: Dec. 15, 2020

(54) LIGHTING MODULE, A LUMINAIRE COMPRISING THE LIGHTING MODULE AND A METHOD OF INSTALLING A LIGHTING MODULE IN A LUMINAIRE

(71) Applicant: SIGNIFY HOLDING B.V., Eindhoven (NL)

(72) Inventors: Vincent Stefan David Gielen, Gastel (NL); Johannes Gerrit Jan Beijer, Bavel (NL); Simon Jacobus Maria Kuppens, Geldrop (NL); Anna Wilhelmina Maria Wondergem-De Best, Veldhoven (NL); Peter Johannes Martinus Bukkems, Deurne (NL); Simon Eme Kadijk, Veldhoven (NL)

(73) Assignee: SIGNIFY HOLDING B.V., Eindhoven (NL)

( * ) Notice: Subject to any disclaimer, the term of this patent is extended or adjusted under 35 U.S.C. 154(b) by 0 days.

(21) Appl. No.: 16/349,389

(22) PCT Filed: Nov. 13, 2017

(86) PCT No.: PCT/EP2017/078993
§ 371 (c)(1),
(2) Date: May 13, 2019

(87) PCT Pub. No.: WO2018/091391
PCT Pub. Date: May 24, 2018

(65) Prior Publication Data

US 2019/0331332 A1 Oct. 31, 2019

(30) Foreign Application Priority Data

Nov. 18, 2016 (EP) ..... 16199571

(51) Int. Cl.
*F21V 29/00* (2015.01)
*F21V 29/70* (2015.01)
(Continued)

(52) U.S. Cl.
CPC ..... *F21V 29/70* (2015.01); *F21V 7/04* (2013.01); *F21V 19/02* (2013.01); *F21V 23/006* (2013.01);
(Continued)

(58) Field of Classification Search
CPC ..... F21V 29/70; F21V 21/30; F21V 19/02; F21K 9/65
(Continued)

(56) References Cited

U.S. PATENT DOCUMENTS 7,278,761 B2 4/2007 Kuan
7,347,706 B1 * 3/2008 Wu ..... H01R 13/7175 430/642
(Continued)

FOREIGN PATENT DOCUMENTS

CN 201110528 Y 9/2008
CN 101839464 A 9/2010
(Continued)

*Primary Examiner* — Matthew J. Peerce
(74) *Attorney, Agent, or Firm* — Daniel J. Piotrowski

(57) ABSTRACT

The invention provides a lighting module (100) for use in a luminaire (200). The lighting module (100) comprises: a base (101) having a longitudinal axis (LA) and being constructed for rotatably connecting the base (101) to a socket (119) of a luminaire (200). The lighting module (100) further comprises a carrier (102) connected to the base (101) and extending from the base (101) in the direction of the longitudinal axis (LA). The lighting 5 module (100) further comprises a light unit (103) comprising a light source (104) and a heat sink (105) for dissipating thermal energy of the light source (104). The heat sink (105) extends in the
(Continued)

direction of the longitudinal axis (LA) and is positioned at a non-zero distance D1 to the longitudinal axis (LA). The lighting module (100) further comprising a connecting construction (106) connecting the light unit (103) rotatably to the carrier (102) for rotating 10 the light unit (103) both around the carrier (102) and longitudinal axis (LA).

13 Claims, 7 Drawing Sheets

(51) Int. Cl.

| | |
|---|---|
| ***F21V 29/503*** | (2015.01) |
| ***F21V 7/04*** | (2006.01) |
| ***F21V 19/02*** | (2006.01) |
| ***F21V 23/00*** | (2015.01) |
| ***F21V 23/06*** | (2006.01) |
| *F21Y 115/10* | (2016.01) |
| *F21W 131/103* | (2006.01) |

(52) U.S. Cl.
CPC ..... *F21V 23/06* (2013.01); *F21V 29/503* (2015.01); *F21W 2131/103* (2013.01); *F21Y 2115/10* (2016.08)

(58) Field of Classification Search
USPC ..... 362/294
See application file for complete search history.

(56) References Cited

U.S. PATENT DOCUMENTS

| | | | | |
|---|---|---|---|---|
| 8,075,163 | B2 * | 12/2011 | Xiao | F21S 2/005 362/287 |
| 2011/0134239 | A1 | 6/2011 | Vadai et al. | |
| 2012/0080994 | A1 | 4/2012 | Chin et al. | |
| 2012/0236602 | A1 * | 9/2012 | Flaherty | H05B 33/0803 362/650 |
| 2014/0218923 | A1 * | 8/2014 | Chi | F21K 9/23 362/249.03 |
| 2015/0117038 | A1 | 4/2015 | Campos et al. | |

FOREIGN PATENT DOCUMENTS

| | | | | |
|---|---|---|---|---|
| DE | 202011051015 | U1 | | 12/2011 |
| JP | 2005276467 | A | | 10/2005 |
| JP | 2016046191 | A | | 4/2016 |
| JP | 2016058139 | A | * | 4/2016 |
| JP | 2016058139 | A | | 4/2016 |
| TW | 201120369 | A | | 6/2011 |
| WO | 2010003300 | A1 | | 1/2010 |

* cited by examiner

LIGHTING MODULE, A LUMINAIRE COMPRISING THE LIGHTING MODULE AND A METHOD OF INSTALLING A LIGHTING MODULE IN A LUMINAIRE

CROSS-REFERENCE TO PRIOR APPLICATIONS

This application is the U.S. National Phase application under 35 U.S.C. § 371 of International Application No. PCT/EP2017/078993, filed on Nov. 13, 2017 which claims the benefit of European Patent Application No. 16199571.7, filed on Nov. 18, 2016. These applications are hereby incorporated by reference herein.

FIELD OF THE INVENTION

The present invention relates to a lighting module for use in a luminaire, a luminaire comprising the lighting module and a method of installing a lighting module in a luminaire. The lighting module may be based on solid state lighting (SSL) technology.

BACKGROUND OF THE INVENTION

US2012/0236602 discloses a light emitting diode (LED) based lamp assembly with a driver assembly having a base portion rotatably engageable with the socket of a light fixture to make a first electrical contact with the light fixture. The driver assembly has an electrically conductive, retractable tip portion coupled to the base portion and that makes a second electrical contact with the light fixture. The tip portion retracts relative to the base when in electrical contact with the light fixture's socket portion. A lamp housing assembly operably connected to the driver assembly has a lamp housing connected to the driver assembly. The lamp housing is coupled to at least one substrate having at least one LED light thereon. The substrate is connected to, or is an integral part of, a heat sink that carries heat away from the substrate and/or LED light. The lamp housing assembly is rotatable relative to the light fixture to adjust the angular position of the light source.

US2011/134239 A1 discloses an LED lamp for outdoor and large space lighting, particularly for streets, warehouses car parks and the like, which is adapted for fitting into legacy light fittings designed for sodium bulbs and the like. The LED lamp comprises a plurality of light emitting diodes arranged over a surface of the lamp, is rotatably connected through a rotatable electrical connection to a screw-in adaptor for insertion into a legacy screw-in socket, such that the screw in adaptor is rotatable independently of the lamp, so that the legacy screw in socket can be used even though the light fitting is too small to allow rotation of the LED lamp. Additional embodiments provide for cooling airflow through the light fitting, for temperature control of the LEDs, and for failure protection, to ensure a longest possible lamp lifetime.

SUMMARY OF THE INVENTION

In view of the above, a concern of the present invention is to provide a lighting module which allows for optimal utilization of the space available within an existing luminaire. This specifically holds for a luminaire which comprises a reflector, because the space available within a reflector is especially limited. For example, the invention describes a lighting module for a street lighting luminaire which enables the use of a relatively large heat sink for cooling the light sources (such as LEDs) of a light unit without modification of the associated luminaire. The relatively large heat sink may obstruct fitting the lighting module into the socket due to the limited space inside the existing luminaire. A large heat sink enables the use of more LEDs or driving the LEDs at a higher current in order to increase the lumen output of the lighting module. Due to its size, said large heat sink may even hamper the lighting module from being rotatably installed in a socket within an existing luminaire.

To address this concern, a lighting module in accordance with the independent claim is provided. Preferred embodiments are defined by the dependent claims.

According to a first aspect of the invention, a lighting module for use in a luminaire is provided comprising a base having a longitudinal axis. The base is constructed for rotatably connecting the base to a socket of a luminaire. A carrier is connected to the base and extending from the base in the direction of the longitudinal axis. The lighting module further comprises a light unit comprising a light source and a heat sink for dissipating thermal energy from the light source. The heat sink extends in the direction of the longitudinal axis and is positioned at a non-zero distance to the longitudinal axis. The lighting module further comprises a connecting construction connecting the light unit rotatably to the carrier for rotating the light unit both around the carrier and longitudinal axis.

Hence, the invention provides a lighting module that allows for optimal utilization of the space available within an existing luminaire. The luminaire comprises a socket and a light exit. The light exit of the luminaire and the socket extend in the same direction, which means that the light exit of the luminaire and the opening of the socket are positioned non-parallel with respect to each other. In an embodiment, the light exit of the luminaire and the opening of the socket are positioned perpendicular with respect to each other. The lighting module according to the invention is able to use a relatively large heat sink without modification of the associated luminaire. The reason is that instead of a lighting module comprising a heat sink positioned on the longitudinal axis of a base and a carrier, a lighting module comprising a light unit comprising a light source and a heat sink is used wherein the heat sink extends in the direction of the longitudinal axis of a base and a carrier and is positioned at a non-zero distance to the longitudinal axis. The lighting module according to the invention further comprises a connecting construction connecting the light unit rotatably to the carrier for rotating the light unit around the carrier and longitudinal axis. During installation of the lighting module, the base is rotatably connected to a socket of a luminaire. The light unit which is rotatably connected to the carrier may rotate with respect to the carrier, but does not substantially rotate with respect to the luminaire during installation. The effect is that a lighting module can be used which comprises a light unit which dimensions are too large to rotatably connect the lighting module to the socket within the luminaire. The light source of the light unit may stay parallel positioned to the light exit surface of the luminaire during installation. The construction of the lighting module in accordance with the present invention enables optimal utilization of the space available within an existing luminaire.

The solution proposed in US2012/0236602 is unable to provide a lighting module that is able to use a large heat sink without modification of the associated luminaire. The reason is that if the dimensions of the heat sink are too large it is impossible to rotatably connect the lighting module to the socket within the luminaire. The solution proposed in US2012/0236602 does not provide a lighting module comprising a light unit which extends in the direction of the longitudinal axis and is positioned at a non-zero distance to the longitudinal axis, and wherein the lighting module comprises a connecting construction connecting the light unit rotatably to the carrier for rotating the light unit around the carrier and longitudinal axis. The light unit in the configuration disclosed in US2012/0236602 is connected in the direction of the longitudinal axis. In most street lighting luminaires the socket is positioned within the luminaire in a direction parallel to the light exit window. Thus a large heat sink positioned in the configuration disclosed in US2012/0236602 will hamper the lighting module from being rotatably connected to a socket within an existing luminaire due to the size and configuration of the heat sink.

In a preferred embodiment, the heat sink is extending along the longitudinal axis. Preferably, the heat sink extends at an angle to the longitudinal axis in the range from −45 to 45 degrees. More preferably, the heat sink extends at an angle to the longitudinal axis in the range from −30 to 30 degrees. Most preferably, the heat sink extends at an angle to the longitudinal axis in the range from −20 to 20 degrees. For example, the heat sink extends at an angle of 10 degrees with respect to the longitudinal axis. In another preferred embodiment, the heat sink is extending parallel to the longitudinal direction of the longitudinal axis i.e. the heat sink extends at an angle of 0 degrees with respect to the longitudinal axis.

In an embodiment, the carrier comprises a driver being electrically connected to the base and the light source. The driver may comprise a driver circuit. The driver circuit converts the electrical output of the luminaire, i.e. the electrical input for the driver, to an electrical output of the driver that is matched to electrical characteristics of the light source such as an LED or LEDs. Typically the electrical input of the driver is an alternating current at a high voltage such as the mains voltage which is converted by the driver circuit into a direct current at a low voltage. The obtained effect is that the electrical output of the driver is safe to touch during connection of the light unit to the electrical connection of the carrier. The electrical output of the carrier is not safe to touch when connecting the light unit to the electrical connection of the carrier in case the light unit comprises the driver. The electrical energy that flows through a portion of the body will cause a shock and may result in injury, devastating damage or death.

In an embodiment, the connecting construction for connecting the light unit rotatably to the carrier comprises an integrated electrical connection for electrically connecting the driver to the light source. The light unit may be mechanically connected and electrically connected to the carrier by a connecting construction with an integrated electrical connection. The obtained effect is that a relatively easy (manual) and safe disconnecting/disassembling is enabled, e.g. without the need for, for example, specific tools, separation of glued parts, breaking parts or complex, time consuming movements and/or operations, like extensive unscrewing or requiring relatively high forces.

The heat sink has a recess and the carrier is partly or fully positioned within the recess. The obtained effect is that it increases the size of the heat sink and thus enables the use of more LEDs or driving the LEDs at a higher current in order to increase the lumen output of the lighting module. The heat sink is made from thermally conductive material such as a metal e.g. copper or aluminum. Use of thermally conductive material with a relatively high thermal conductivity may enhance heat dissipation, wherein higher values of thermal conductivity may provide higher levels of heat dissipation.

In an embodiment, the light source comprises a plurality of solid state light emitters being arranged in an elongated solid state light emitter array extending in the direction of the longitudinal axis. The obtained effect is that it increases the lumen output of the lighting module and efficiently cools the LEDs by separating the LEDs in one direction (i.e. a linear configuration instead of a spot configuration).

In an embodiment, the light source comprises an optical element being positioned in the optical path of the light source and being configured for redirecting light of the light source. The optical element may be selected from the group of: a reflective optical element, a diffractive optical element, a refractive optical element, or a scattering optical element (i.e. an element with scattering particles such as Al2O3, TiO2 and/or BaSO4). The obtained effect is to redirect the light and achieve a light distribution which optimally illuminates a surface such as a road. For example, the optical element may collimate the light in order to provide high utilization of the light e.g. on a road.

In an embodiment, the connection construction connects the light unit to the carrier at a position on the longitudinal axis. The obtained effect is that a relatively easy (manual) and safe installation of the lighting module in a luminaire is enabled, e.g. without the need for, for example, specific tools.

In an embodiment, a further connection construction rotatably connects the light unit to the carrier at an outer position of the outer wall of the carrier where the carrier is circular shaped. The obtained effect is that a relatively easy (manual) and mechanical stable connection of the light unit with the carrier is enabled.

In an embodiment, the connecting construction comprises a locking means for locking the position of the lighting unit with respect to the carrier. The obtained effect is a fixation of the orientation of the light unit with respect to the carrier and thus also the light exit of the luminaire, for example the light exit of a reflector of a luminaire. In case of no locking means, a storm or earthquake may change the position of the light unit with respect the carrier and thus also the light exit of a luminaire, for example the light exit of a reflector of a luminaire such that does not illuminates the intended area efficiently.

In an embodiment, the connecting construction comprises a rotating mechanism for rotating around the carrier, the rotating mechanism comprises a first connector, the lighting unit comprises a second connector, the first connector and the second connecter being arranged for providing mechanical and electrical connection.

In an embodiment, the light unit comprises an active cooling device configured for removing thermal energy from the light source and/or heat sink. The obtained effect is an improved cooling which enables the use of more LEDs or driving LEDs at a higher current.

In an embodiment, the carrier further comprises a further light source. The obtained effect is that it increases the lumen output of the lighting module. The carrier may comprise the further light source. The light source provides a light distribution directed in a first main direction, while the further light source provides a light distribution directed in a second main direction, different from the first main direction. The first main direction may be opposite to the second main direction. The further light source may provide indirect light i.e. light which is at least substantially redirected by the reflector of the luminaire, while the light source may provide direct light i.e. light that is not (substantially) redirected by the reflector of the luminaire.

A luminaire comprising a lighting module according to the invention is provided.

In an embodiment, the luminaire further comprises a reflector. The lighting module has a radius which extends in a direction perpendicular with respect to the longitudinal axis and has a distance from the longitudinal axis to at least one edge of the lighting module. The reflector has a radius extending in a direction perpendicular with respect to the longitudinal axis and has a distance from the longitudinal axis to the innerside of the reflector. At least at one point on the longitudinal axis the distance from the longitudinal axis to at least one edge of the lighting module is larger than the distance from the longitudinal axis to the innerside of the reflector. The obtained effect is that it enables the use of a larger heat sink and improved cooling of the light source and/or heat sink.

In an embodiment, the light unit is at least partly extending outside the reflector. The obtained effect is that it enables the use of a larger heat sink and improved cooling of the light source and/or heat sink.

A method of installing a lighting module in a luminaire is provided. The method comprising: rotatably connecting the base to the socket of the luminaire, and either: (i) whereby the light unit rotates with respect to the carrier to obtain a position of the light source, or (ii) mounting the light unit on the carrier in the direction towards the longitudinal axis using the connecting construction, wherein the light source has a predefined position with respect to the light exit of the reflector. The obtained effect of the first option (i) is that it enables direct fixation of the lighting module including the light unit in a luminaire. The obtained effect of the second option (ii) is that it enables easy rotatably connecting the base to the socket of the luminaire followed by connecting the light unit to the carrier.

BRIEF DESCRIPTION OF THE DRAWINGS

Embodiments of the invention will now be described, by way of example only, with reference to the accompanying schematic drawings in which corresponding reference symbols indicate corresponding parts, and in which.

The schematic drawings are not necessarily on scale.

The same features having the same function in different figures are referred to with the same references.

DETAILED DESCRIPTION OF THE EMBODIMENTS

Figure 1A:
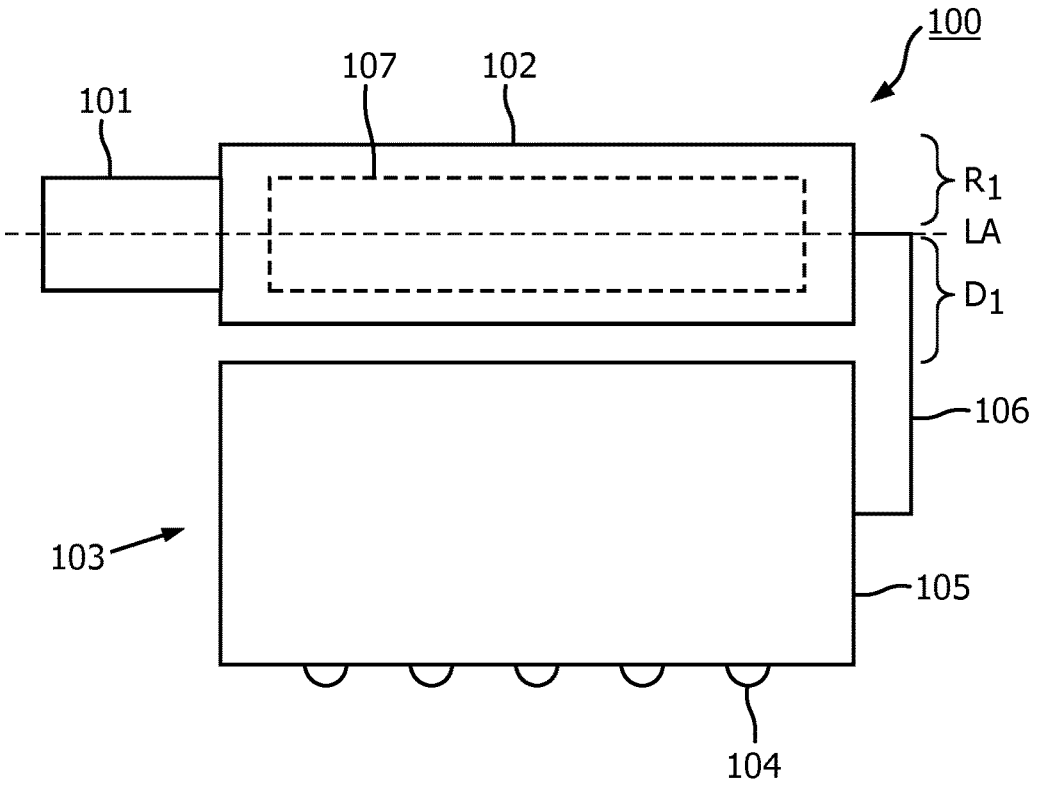
FIGS. 1*a* to 1*c* schematically depict a cross-section and a side view, respectively, of a lighting module according to an embodiment of the present invention.
Figure 1B:
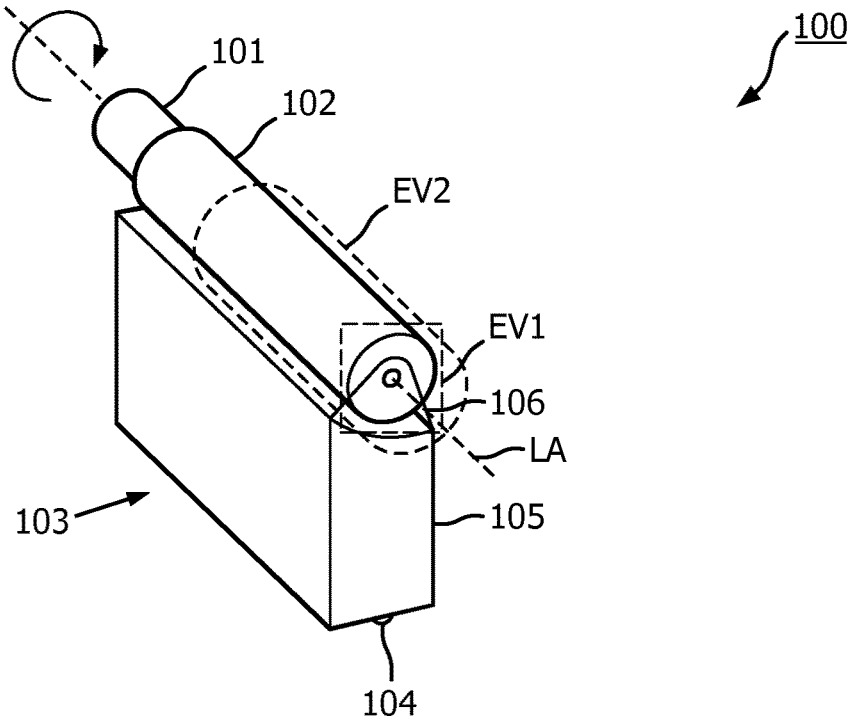

FIGS. 1*a* and 1*b* schematically depict a cross-section and a side view, respectively, of a lighting module 100 according to an embodiment of the present invention. As depicted in FIGS. 1*a* and 1*b*, the lighting module 100 for use in a luminaire 200 (see FIGS. 8 and 9) comprises a base 101 which has a longitudinal axis LA and is constructed to be rotatably connecting the base 101 to a socket 119 (see FIGS. 8 and 9) of a luminaire 200. This construction allows the base 101 to be screwed i.e. rotatably connected into a socket 119 for connecting the lighting module 100 e.g. a lamp to an electrical power source (not shown in FIG. 1, see FIGS. 6 and 7). The lighting module 100 further comprises a carrier 102 connected to the base 101 and extends from the base 101 in the direction of the longitudinal axis LA. The lighting module 100 further comprises a light unit 103 comprising a light source 104 and a heat sink 105 which dissipates thermal energy of the light source 104. The heat sink 105 extends in the direction of the longitudinal axis LA and is positioned at a non-zero distance D1 to the longitudinal axis LA. The lighting module 100 further comprises a connecting construction 106 to connect the light unit 103 rotatably to the carrier 102 to rotate the light unit 103 both around the carrier 102 and longitudinal axis LA. In the embodiment shown in FIGS. 1*a* and 1*b* the rotational movement of the lighting unit 103 around the carrier 102 is required because the heat sink 105 is positioned at a distance D1 to the longitudinal axis LA, wherein the distance D1 is at least larger than the radius R1 of the carrier 102 which extends in the direction perpendicular with respect to the longitudinal axis LA. The connection construction 106 mechanically connects the carrier 102 at a position on the longitudinal axis LA. The connection construction 106 which mechanically connects the carrier 102 at a position on the longitudinal axis LA is designed such that it allows rotation of the light unit 103 around the carrier. For example, the connection construction 106 which mechanically connects the carrier 102 at a position on the longitudinal axis LA is a pin or any other known manner. The effect is that a lighting module 100 can be used which comprises a light unit 103 which dimensions are too large to rotatably connect the lighting module 103 to the socket within the luminaire, while carrier 102 due to the rotational connection can be screwed into socket of a luminaire. This specifically holds for a luminaire which comprises a reflector, because the space available within a reflector is especially limited. Thus the effect is that a lighting module 100 can be used which comprises a light unit 103 which dimensions are too large to rotatably connect the lighting module 103 to the socket within the reflector of the luminaire, while carrier 102 due to the rotational connection can be screwed into socket of a luminaire.

As depicted in FIG. 1*a*, the carrier 102 may further comprise a driver 107 being electrically connected to the base 101 and the light source 104. In the embodiment shown in FIG. 1*a* the electrically connections of the driver 107 to the base 101 and the light source 104 are not shown. The connection of the driver 107 to the base can be established by any know manner such as one electrical conductive wire from the driver 107 to at least one contact at the tip, and one electrical conductive wire from the driver 107 to at least one contact at the shell of the base 101. For example, the base 101 may be made from a metal. For example, the base 101 may be a cap such as an Edison screw or a bayonet mount.

Figure 1C:
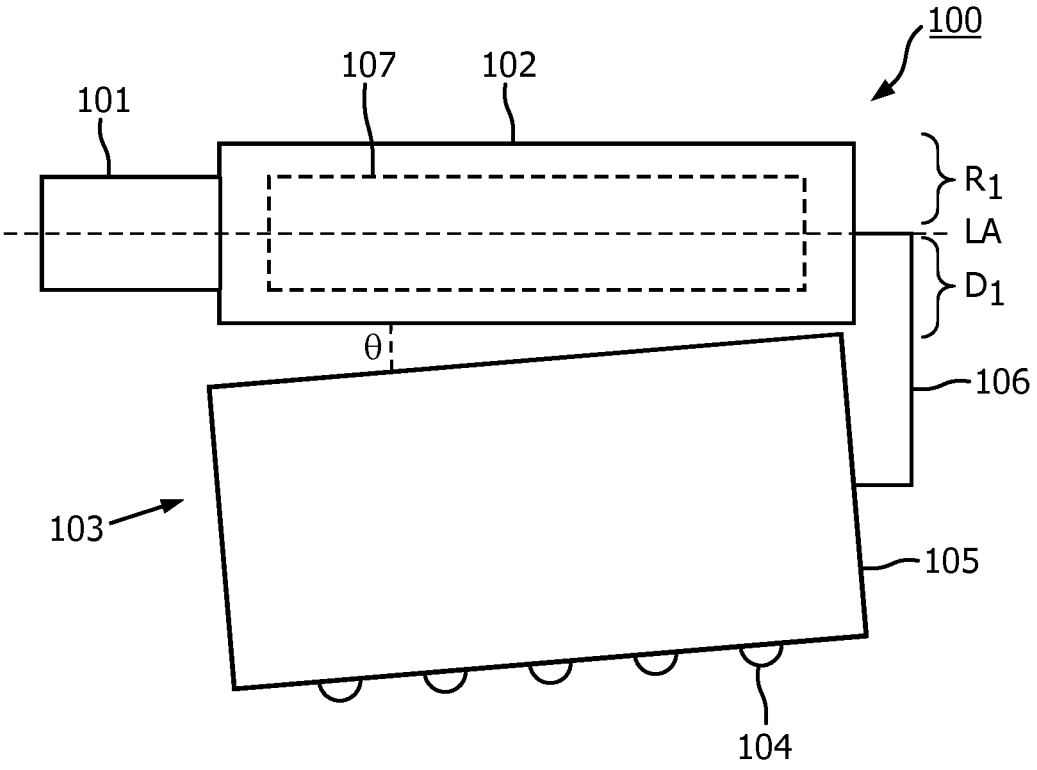

As depicted in FIG. 1*c*, the heat sink 105 extends at an angle θ to the longitudinal axis LA. In the embodiment shown in FIG. 1*c*, the heat sink 105 extends at an angle θ of 10 degrees with respect to the longitudinal axis LA. By positioning the heat sink 105 at an angle θ different from 0 with respect to the longitudinal axis LA the light source 104 may also be positioned under the angle θ with respect to the longitudinal axis LA. Positioning the light source 104 under an angle θ different from 0 with respect to the longitudinal axis LA allows to direct light or to direct more light to a surface area or object which is positioned not perpendicular with respect to the longitudinal axis LA and the lighting module 100. For example, it may desired that a street lighting luminaire 200 provides light or provides more light to an area on the street which is located at an angle θ different from 0 with respect to the longitudinal axis LA and the lighting module 100. The heat sink 105 may also be positioned at another angle θ with respect to the longitudinal axis LA. Preferably, the heat sink extends at an angle to the longitudinal axis in the range from −45 to 45 degrees. More preferably, the heat sink extends at an angle to the longitudinal axis in the range from −30 to 30 degrees. Most preferably, the heat sink extends at an angle to the longitudinal axis in the range from −20 to 20 degrees. Especially, the heat sink extends parallel to the longitudinal direction of the longitudinal axis i.e. the heat sink 105 extends at an angle of 0 degrees with respect to the longitudinal axis LA, because often most light is needed at an area perpendicular to the longitudinal axis LA and the lighting module 100. The orientation of the heat sink 105 with respect to the longitudinal axis LA may also be adjustable. For example, the heat sink may be mounted under an angle θ of 10 degrees with respect to the longitudinal axis LA, or may be mounted under an angle θ of 20 degrees with respect to the longitudinal axis LA.

Figure 2:
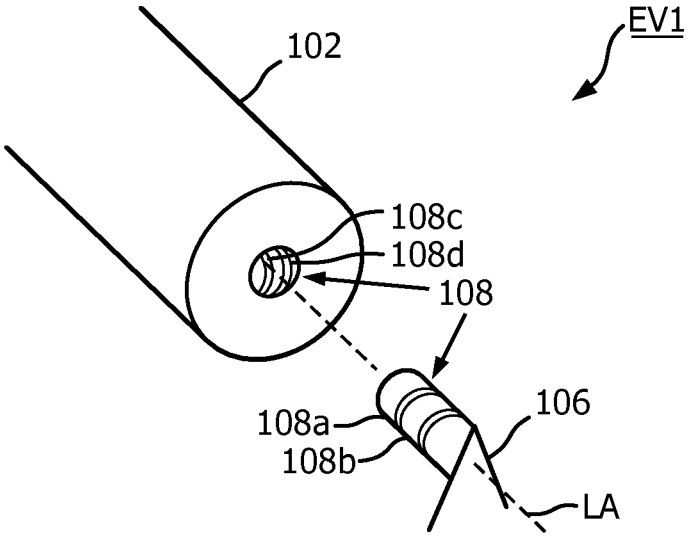
FIG. 2 schematically depicts an exploded view EV1 of part of the lighting module according to an embodiment of the present invention.

FIG. 2 schematically depicts an exploded view EV1 of part of the lighting module 100 according to an embodiment of the present invention. As depicted in FIG. 2, the connecting construction 106 which mechanically connects the light unit 103 rotatably to the carrier 102 also comprises an integrated electrical connection 108 for electrically connecting the driver 107 to the light source 104. In the embodiment shown in FIG. 2 the connection construction 106 comprises an electrical contact point 108*a* and an electrical contact point 108*b*. The carrier 102 comprises an electrical contact point 108*c* and an electrical contact point 108*d*. In case of electrical connection between the driver 107 to the light source 104 the electrical contact point 108*a* makes contact with the electrical contact point 108*c*, and the electrical contact point 1*b* makes contacts with the electrical contact point 108*d*. The electrical connection points 108*a* and 108*b* are circumferentially arranged and may extend around the entire circumference of the outer surface of the connection construction 106. The electrical connection points 108*c* and 108*d* are circumferentially arranged and may extend around the entire circumference of the inner surface of the carrier 102. Examples of connection constructions include but are not limited to electrically conducting terminals, pins or plugs.

Figure 3A:
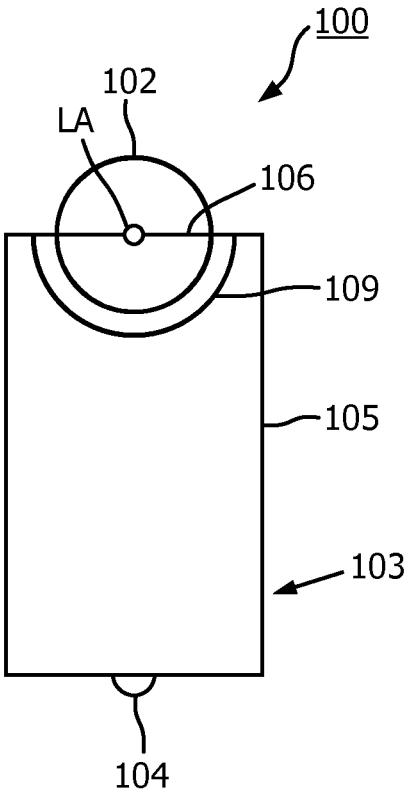
FIGS. 3*a* and 3*b* schematically depict front views of a lighting module according to an embodiment of the present invention.
Figure 3B:
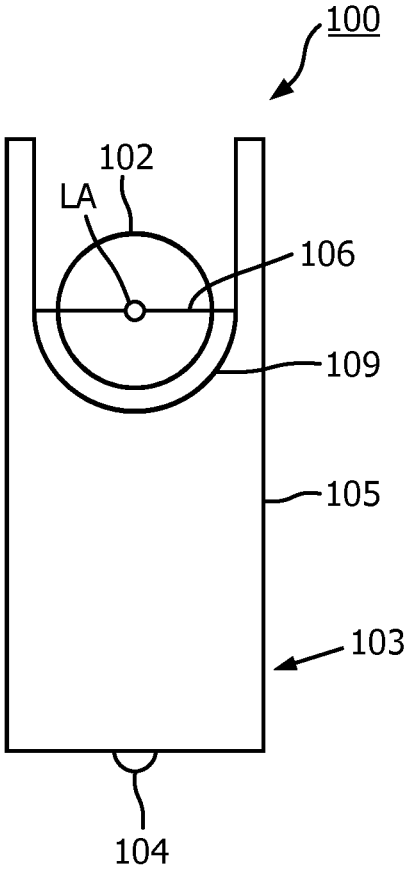

FIGS. 3*a* and 3*b* schematically depict front views of a lighting module 100 according to an embodiment of the present invention. As depicted in FIG. 3*a*, the heat sink 105 may have a recess 109 at a portion directed towards the carrier 102 and extends in the direction of the longitudinal axis LA and the carrier 102 is partly positioned within the recess 109 as is shown in FIG. 3*a*. As shown in FIG. 3A, the carrier 102 is partly positioned within the recess 109 up to the longitudinal axis LA. The heat sink 105 may also comprise a heat pipe. The thermal conductivity of the heat sink 105 is preferably at least 50 $W \cdot m^{-1} \cdot K^{-1}$, more preferably at least 100 $W \cdot m^{-1} \cdot K^{-1}$, and most preferably at least 150 $W \cdot m^{-1} \cdot K^{-1}$. For example, the thermal conductivity of the heat sink 105 made of aluminum is about 200 $W \cdot m^{-1} \cdot K^{-1}$. The thermal conductivity of the heat sink 105 made of copper is about 400 $W \cdot m^{-1} \cdot K^{-1}$. A heat pipe has typically even a higher thermal conductivity with respect to aluminum and copper.

As depicted in FIG. 3*b*, the heat sink 105 may have a recess 109 and the carrier 102 is fully positioned within the recess 109. The boundary of the carrier 102 which is directed to the exit of the recess 109 is at least flush with the exit of the recess 109. In the embodiment shown in FIG. 3B the carrier 102 is further recessed in the recess 109 i.e. there is a distance between the boundary of the carrier 102 which is directed to the exit of the recess 109 and the exit of the recess 109.

Figure 4:
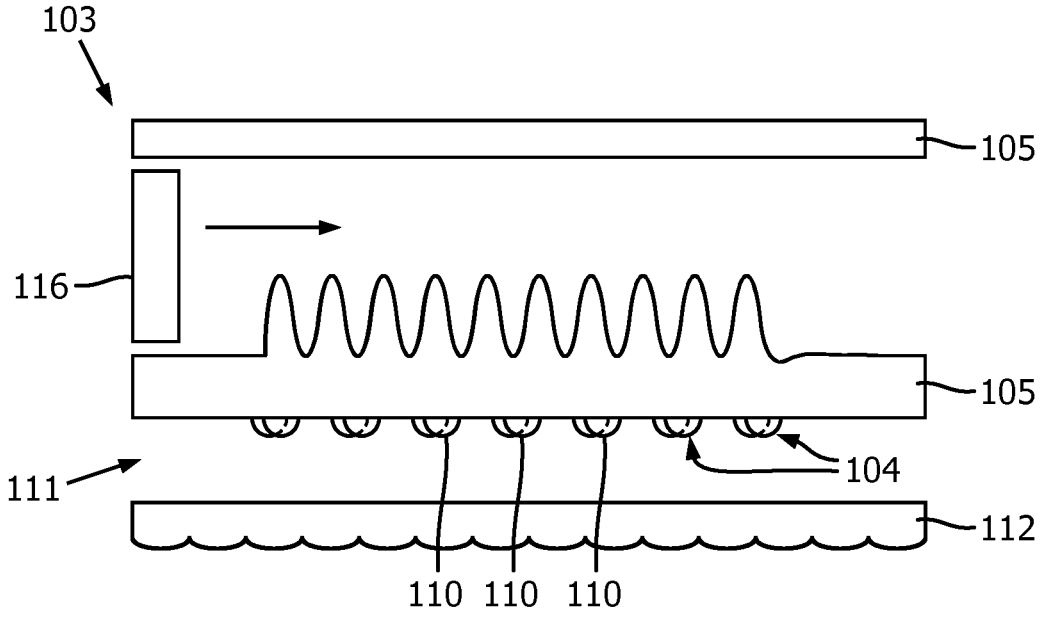
FIG. 4 schematically depicts a cross section of a lighting module according to an embodiment of the present invention.

FIG. 4 schematically depicts a cross section of a lighting module 100 according to an embodiment of the present invention. As depicted in FIG. 4, the light source 104 may comprise a plurality of solid state light emitters 110 being arranged in an elongated solid state light emitter array 111 extending in the direction of the longitudinal axis LA. For example, an elongated solid state light emitter array 111 of forty solid state light emitters 110 in a two by twenty configuration may be used. But any other arrangement of a plurality of rows and columns may be implemented.

As depicted in FIG. 4, the light source 104 may also comprise an optical element 112 being positioned in the optical path of the light source 104 and being configured to redirect the light of the light source 104 wherein the optical element 112 is selected from the group of: a reflective optical element, a diffractive optical element, a refractive optical element, or a scattering optical element. The reflective optical element may comprise multiple reflective sections. For example, light emitted by single solid state light emitter e.g. a single LED may be collimated by a separate reflective section. The diffractive optical element may comprise multiple diffractive sections. Each diffractive section may correspond to a single solid state light emitter e.g. a single LED. The refractive optical element may comprise multiple refractive sections. For example, the refractive optical element may comprise a lens array. The scattering element may comprise scattering material. The optical element 112 may be positioned in the proximity mode i.e. directly covering the solid state emitters e.g. LEDs, in the vicinity mode i.e. arranged at a distance of 1 to 10 mm from the solid state emitters e.g. LEDs, or in the remote mode i.e. arranged at a distance of 10 to 50 mm from the solid state emitters e.g. the LEDs. The optical element 112 may be connected to the heat sink e.g. via pins, plugs or any other known manner.

Referring back to FIG. 4, the light unit 103 may comprise an active cooling device 116 to remove thermal energy from the light source 104 and/or the heat sink 105. The active cooling device 106 uses energy to cool the LEDs directly or indirectly via cooling the heat sink 105. A heat sink 105 involves passive cooling that uses no energy. The active cooling device 116 includes but is not limited to a simple rotary fans, thermoelectric coolers abbreviated as TECs, piezoelectric fans abbreviated as PZFs, synthetic jets abbreviated as SJs and liquid cooling such as microchannels. In the embodiment shown in FIG. 4 the active cooling device 116 is positioned at one end of the heat sink 105. The light unit 103 may also comprise two active cooling devices (not shown). The active cooling device 116 may also be positioned inside the heat sink 105 (not shown).

Figure 5:
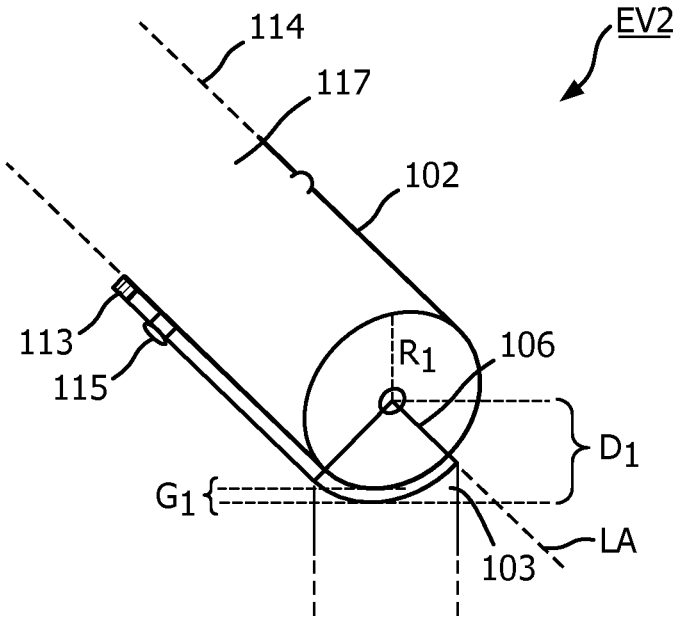
FIG. 5 schematically depicts an exploded view EV2 of a lighting module according to an embodiment of the present invention.

FIG. 5 schematically depicts an exploded view EV2 of a lighting module 100 according to an embodiment of the present invention. As depicted in FIG. 5, the connection construction 106 may connect the light unit 103 to the carrier 102 at a position on the longitudinal axis LA. In the embodiment shown in FIG. 5, the connection construction 106 connects the light unit 103 to the carrier 102 by a pin construction (see also FIG. 2). The connection construction 106 may connect the light unit 103 to the carrier 102 also by any other known connection construction 106 such as a plug. The light module extends in the direction of the longitudinal axis LA and is positioned at a non-zero distance D1 to the longitudinal axis LA. The carrier 102 has a maximum radius R1. The distance D1 is larger than the maximum radius R1. The difference in length between the distance D1 and maximum radius R1 is the gap G1 between the carrier 102 and the light unit 103. The gap G1 is preferably in the range of 1 to 30 mm, more preferably in the range of 2 to 20 mm, most preferably in the range of 3 to 10 mm.

As depicted in FIG. 5, a further connection construction 113 may rotatably connect the light unit 103 to the carrier 102 at an outer position of the outer wall 114 of the carrier 102 where the carrier 102 is circular shaped. In the embodiment shown in FIG. 5, the further connection construction 113 is a sliding means. The sliding means is for example a pin, plug, brush, spring, roller or any other known manner to rotatably connect the light unit 103 to the carrier 102 at an outer position of the outer wall 114 of the carrier 102.

As depicted in FIG. 5, the connecting construction 106 may comprise a locking means 115 for locking the position of the lighting unit 103 with respect to the carrier 102. In the embodiment shown in FIG. 5, the locking means 115 to lock the position of the lighting unit 103 with respect to the carrier 102 is a screw. The locking means may also be any other know manner to lock the position of the lighting unit 103 with respect to the carrier 102. For example, the locking means may be a pin or a clip. The carrier may comprise a means for establishing the connection corresponding to the locking means 115. For example, the carrier 102 may comprise screw thread.

As depicted in FIG. 5, the carrier 102 may further comprise a further light source 117. In the embodiment shown in FIG. 5, the further light source 117 is positioned on the carrier 102. In order to be able to rotate the carrier 102 with respect to the light unit 103, the gap or distance between the carrier 102 and the light unit 103 is the height of the protruding portion of the further light source 117. For example, the height of the further light source 117 is 3 mm. The distance between the carrier 102 and the light unit 103 is, for example, 5 mm. The further light source 117 is a further solid state emitter. The further solid state emitter is for example a further LED. The further LED may also be positioned inside the carrier 102. The further light source 117 may also comprise multiple further solid state emitters. The further solid state emitters may also comprise multiple LEDs. The further light source 117 may emit white light. The further light source 117 may be phosphor converted LED. The further light source 117 may be RGB LED (i.e. colored LEDs which emit red, green and blue light).

Figure 6:
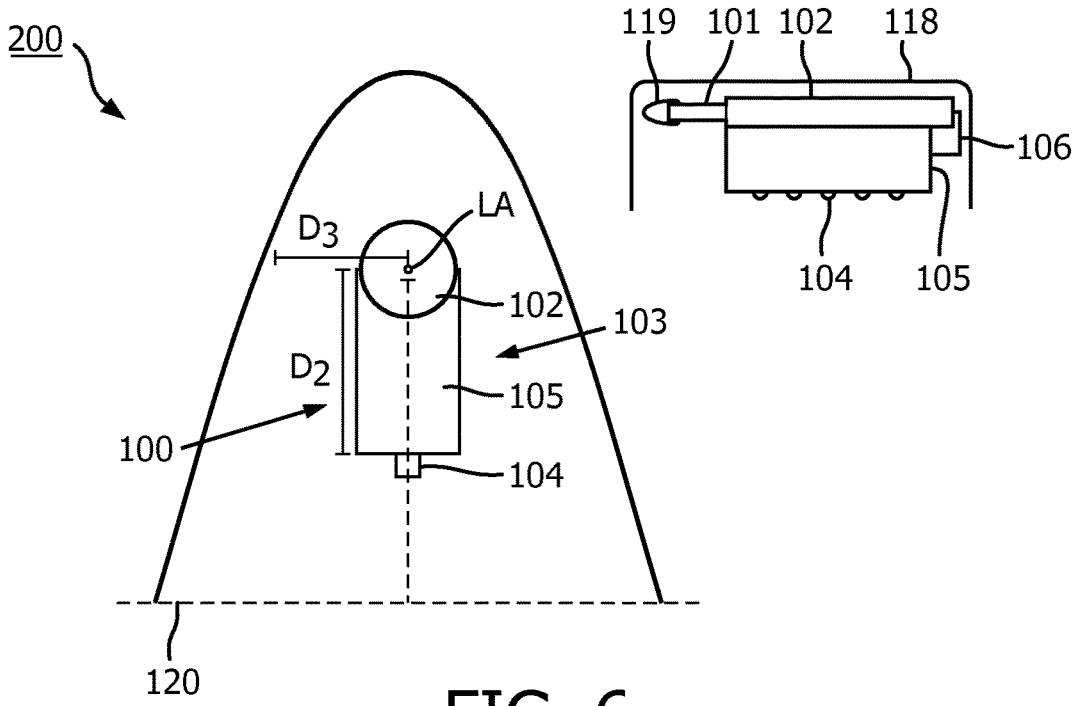
FIG. 6 schematically depicts a cross-section of a lighting module in a reflector according to an embodiment of the present invention.

FIG. 6 schematically depicts two cross-sections of a lighting module 100 in a reflector 118 according to an embodiment of the present invention. As depicted in FIG. 6, the luminaire 200 may comprise the reflector 118 and lighting module 100. The lighting module 100 has a radius which extends in a direction perpendicular with respect to the longitudinal axis LA and has a distance D2 from the longitudinal axis LA to at least one edge of the lighting module 100. The reflector 118 has a radius which extends in a direction perpendicular with respect to the longitudinal axis LA and has a distance D3 from the longitudinal axis LA to the innerside of the reflector 118. In the embodiment shown in FIG. 6, there is at least at one point on the longitudinal axis LA the distance D2 is larger than the distance D3. The luminaire comprises a socket 119 and a reflector 118 which comprises a light exit 120. In the embodiment of FIG. 6, the light exit 120 of the reflector 118 and the opening of the socket 119 are positioned perpendicular with respect to each other. The lighting module 100 comprises a light unit 103 which comprises a light source 104 and a heat sink 105. The heat sink 105 extends in the direction of the longitudinal axis LA of the base 101 and a carrier 102 and is positioned at a non-zero distance to the longitudinal axis LA. The lighting module 100 has a connecting construction 106 connecting the light unit 103 rotatably to the carrier 102 for rotating the light unit 103 around the carrier 102 and longitudinal axis LA. During installation of the lighting module 100, the base 101 is rotatably connected to a socket 119 of a luminaire. The light unit 103 which is rotatably connected to the carrier 102 rotates with respect to the carrier 102, but does not substantially rotate with respect to the reflector 118 of the luminaire during installation. In this way, lighting module 100 can be used which comprises a light unit 103 which dimensions are too large to rotatably connect the lighting module 100 to the socket 119 within the reflector 118 of the luminaire 200. The light source 104 of the light unit 103 is parallel positioned to the light exit surface 120 of the luminaire 200 during installation.

Figure 7:
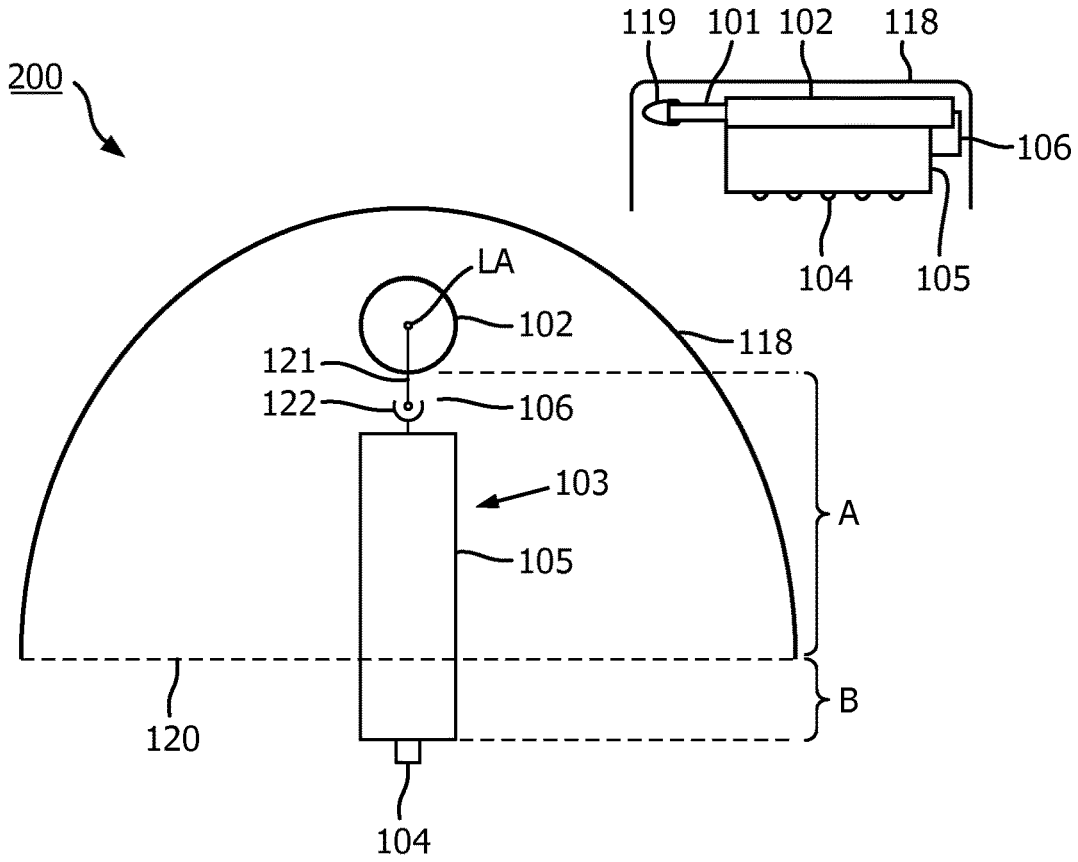
FIG. 7 schematically depicts a cross-section of a lighting module in a reflector according to an embodiment of the present invention.

FIG. 7 schematically depicts a two cross-sections of a lighting module 100 in a reflector 118 according to an embodiment of the present invention. As depicted in FIG. 7, the light unit 103 may at least partly extend outside the reflector 118. The luminaire comprises a socket 119 and a reflector 118 which comprises a light exit 120. In the embodiment of FIG. 7, the light exit 120 of the reflector 118 and the opening of the socket 119 are positioned perpendicular with respect to each other. The lighting module 100 comprises a light unit 103 which comprises a light source 104 and a heat sink 105. The heat sink 105 extends in the direction of the longitudinal axis LA of the base 101 and a carrier 102 and is positioned at a non-zero distance to the longitudinal axis LA. The lighting module 100 has a connecting construction 106 connecting the light unit 103 rotatably to the carrier 102 for rotating the light unit 103 around the carrier 102 and longitudinal axis LA. During installation of the lighting module 100, the base 101 is rotatably connected to a socket 119 of a luminaire. The light unit 103 which is rotatably connected to the carrier 102 rotates with respect to the carrier 102, but does not substantially rotate with respect to the reflector 118 of the luminaire during installation. In this way, lighting module 100 can be used which comprises a light unit 103 which dimensions are too large to rotatably connect the lighting module 100 to the socket 119 within the reflector 118 of the luminaire. The light source 104 of the light unit 103 is parallel positioned to the light exit surface 120 of the luminaire during installation.

Referring back to FIG. 7, the connecting construction 106 may comprise a rotating mechanism for rotating around the carrier. The rotating mechanism may comprise a first connector 121 and the lighting unit may comprise a second connector 122. For example, the first connector 121 may extend in a radial direction with respect to the longitudinal axis (LA). The first connector 121 and the second connecter 122 may provide mechanical and electrical connection. For example, the first connector 121 and the second connecter 122 may provide mechanical and electrical connection in the radial direction.

Figure 8A:
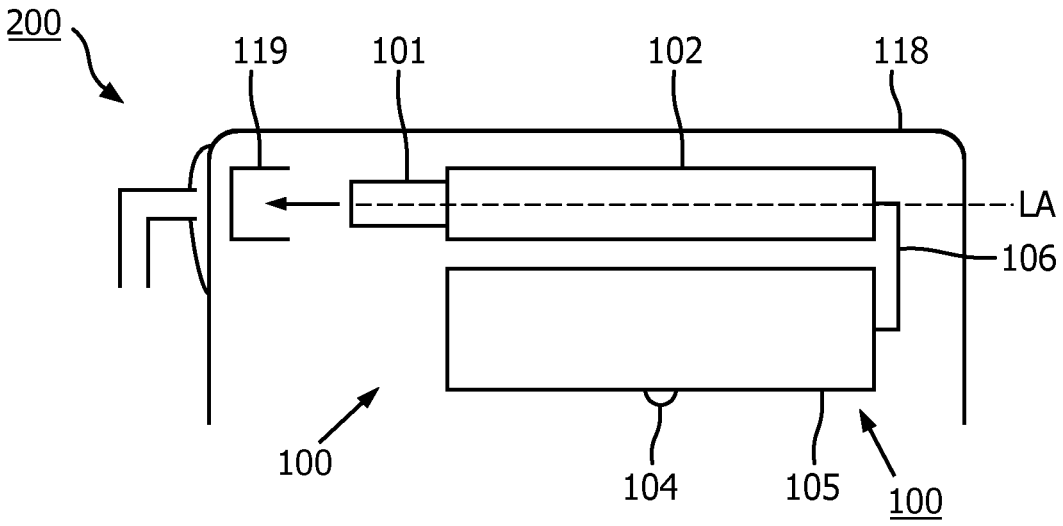
FIGS. 8*a* and 8*b* schematically depict two cross-sections of a lighting module in a reflector of a luminaire and two positions of the lighting unit within the reflector to explain a method of installing a lighting module according to an embodiment of the present invention.
Figure 8B:
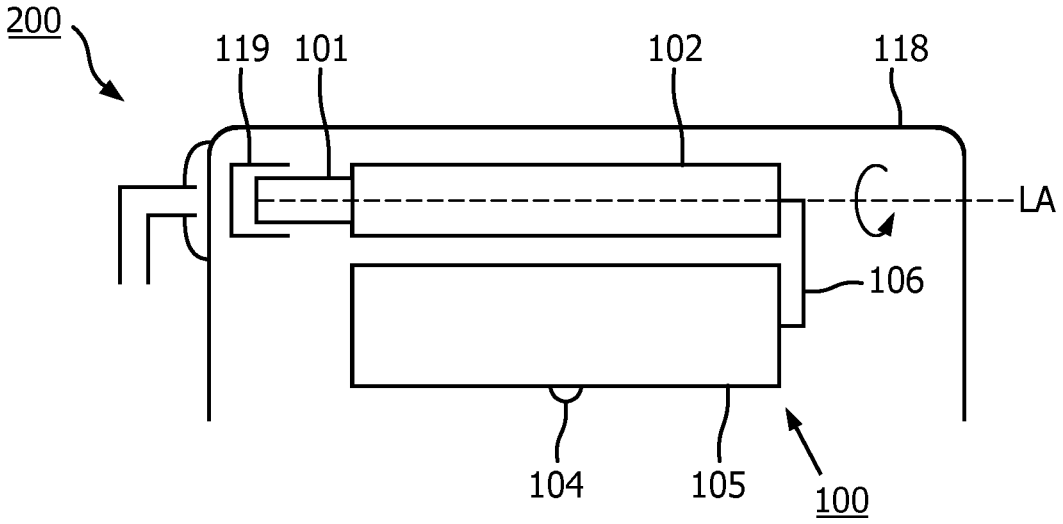

FIGS. 8*a* and 8*b* schematically depicts two cross-section of a lighting module 100 in a reflector 118 and a method of installing a lighting module according to an embodiment of the present invention. As depicted in FIGS. 8*a* and 8*b*, the method of installing a lighting module comprises: rotatably connect the base 101 to the socket 119 of the luminaire 200, whereby the light unit 103 rotates with respect to the carrier 102 to obtain a position of the light source 104, wherein the light source 104 has a predefined position with respect to the light exit of the reflector 118.

Figure 9A:
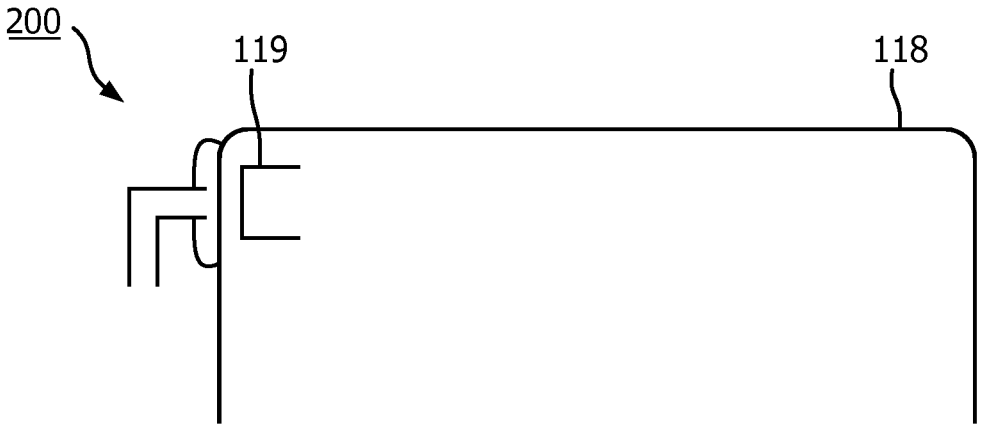
FIGS. 9*a* to 9*c* schematically depict two cross-sections of a lighting module in a reflector of a luminaire and a method of installing a lighting module according to an embodiment of the present invention.
Figure 9B:
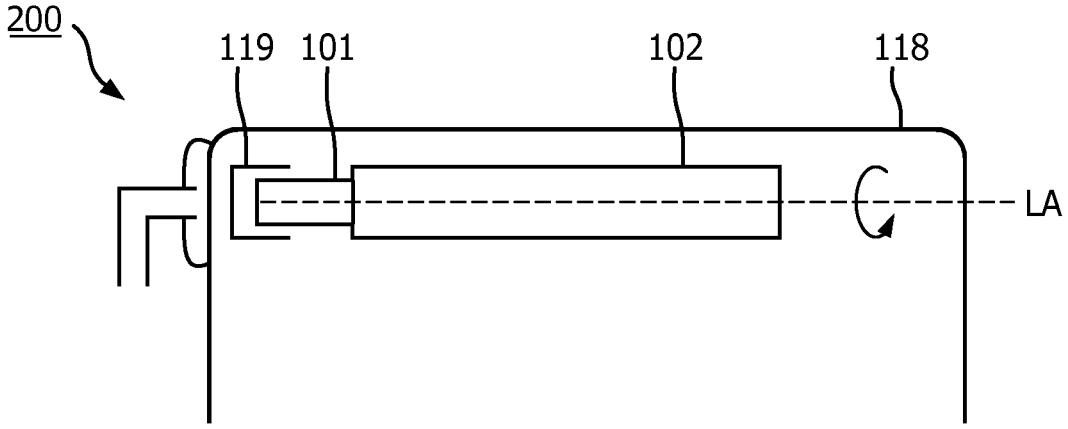
Figure 9C:
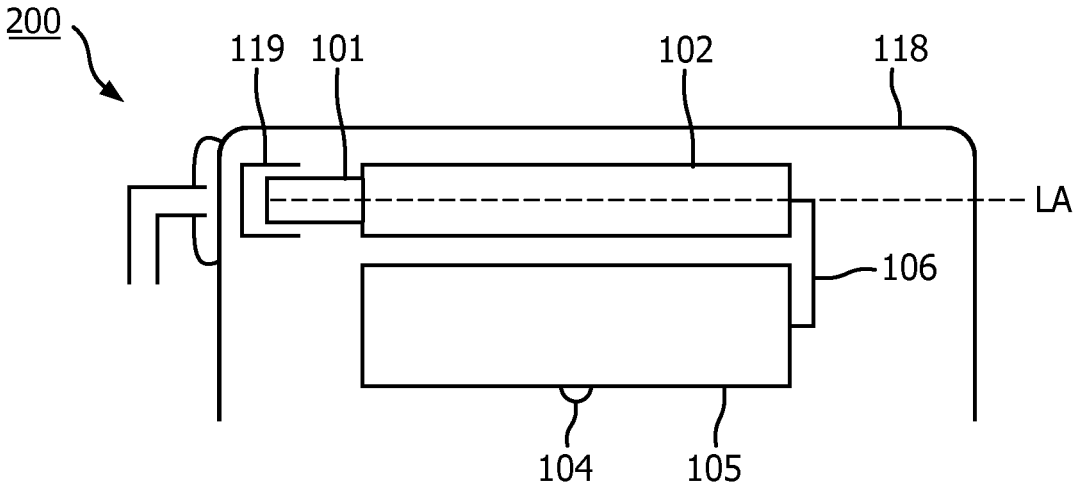

FIGS. 9*a* to 9*c* schematically depicts two cross-section of a lighting module 100 in a reflector 118 and a method of installing a lighting module 100 according to an embodiment of the present invention. The method comprises: rotatably connect the base 101 to the socket 119 of the luminaire 200, and mount the light unit 103 on the carrier 102 in the direction towards the longitudinal axis LA using the connecting construction 106, wherein the light source 104 has a predefined position with respect to the light exit 120 of the reflector 118.

The term luminaire 200 may define a fixture or any other device for holding a lamp, and optionally a reflector.

For example, when the lighting module 100 is applied in a streetlamp it provides high lumen-output and high utilization of the light which, and it enables to replace a conventional high pressure sodium lamp without modification of the associated luminaire 200.

The light source 104 may be a solid state light emitter. Examples of solid state light emitters are Light Emitting Diodes (LEDs), Organic Light Emitting diode(s) OLEDs, or, for example, laser diodes. Solid state light emitters are relatively cost effective, have a relatively large efficiency and a long life-time. The LED light source may be a phosphor converted LED (a LED comprising a luminescent material) or a colored LED (a LED not comprising a luminescent material). The luminescent material is arranged for converting at least part of the light emitted by the LED into light of a longer wavelength. The luminescent material may be an organic phosphor, an inorganic phosphor and/or a quantum dot based material.

The lighting module 100 may be configured to provide white light. The term white light herein, is known to the person skilled in the art and relates to white light having a correlated color temperature (CCT) between about 2.000 K and 20.000 K. In an embodiment the CCT is between 2.500 K and 10.000K. Usually, for general lighting, the CCT is in the range of about 2700K to 6500K. Preferably, it relates to white light having a color point within about 15, 10 or 5 SDCM (standard deviation of color matching) from the BBL (black body locus). Preferably, it relates to white light having a color rendering index (CRI) of at least 70 to 75, for general lighting at least 80 to 85.

The term "substantially" herein, such as in "substantially all light" or in "substantially consists", will be understood by the person skilled in the art. The term "substantially" may also include embodiments with "entirely", "completely", "all", etc. Hence, in embodiments the adjective substantially may also be removed. Where applicable, the term "substantially" may also relate to 90% or higher, such as 95% or higher, especially 99% or higher, even more especially 99.5% or higher, including 100%. The term "comprise" includes also embodiments wherein the term "comprises" means "consists of". The term "and/or" especially relates to one or more of the items mentioned before and after "and/or". For instance, a phrase "item 1 and/or item 2" and similar phrases may relate to one or more of item 1 and item 2. The term "comprising" may in an embodiment refer to "consisting of" but may in another embodiment also refer to "containing at least the defined species and optionally one or more other species".

Furthermore, the terms first, second, third and the like in the description and in the claims, are used for distinguishing between similar elements and not necessarily for describing a sequential or chronological order. It is to be understood that the terms so used are interchangeable under appropriate circumstances and that the embodiments of the invention described herein are capable of operation in other sequences than described or illustrated herein.

The devices herein are amongst others described during operation. As will be clear to the person skilled in the art, the invention is not limited to methods of operation or devices in operation.

It should be noted that the above-mentioned embodiments illustrate rather than limit the invention, and that those skilled in the art will be able to design many alternative embodiments without departing from the scope of the appended claims. In the claims, any reference signs placed between parentheses shall not be construed as limiting the claim. Use of the verb "to comprise" and its conjugations does not exclude the presence of elements or steps other than those stated in a claim. The article "a" or "an" preceding an element does not exclude the presence of a plurality of such elements. The invention may be implemented by means of hardware comprising several distinct elements, and by means of a suitably programmed computer. In the device claim enumerating several means, several of these means may be embodied by one and the same item of hardware. The mere fact that certain measures are recited in mutually different dependent claims does not indicate that a combination of these measures cannot be used to advantage.

The invention further applies to a device comprising one or more of the characterizing features described in the description and/or shown in the attached drawings. The invention further pertains to a method or process comprising one or more of the characterizing features described in the description and/or shown in the attached drawings.

The various aspects discussed in this patent can be combined in order to provide additional advantages. Further, the person skilled in the art will understand that embodiments can be combined, and that also more than two embodiments can be combined. Furthermore, some of the features can form the basis for one or more divisional applications.

The invention claimed is:

1. A lighting module for use in a luminaire and comprising:

a base having a longitudinal axis (LA) and being constructed for rotatably connecting the base to a socket of a luminaire, a carrier connected to the base and extending from the base in the direction of the longitudinal axis (LA), a light unit comprising a light source and a heat sink for dissipating thermal energy of the light source, wherein the heat sink has a length that longitudinally extends in substantially the same direction as the longitudinal axis (LA), and is positioned at a non-zero distance D1 to the longitudinal axis (LA), wherein the lighting module comprising a connecting construction connecting the light unit rotatably to the carrier for rotating the light unit both around the carrier and longitudinal axis (LA) and, wherein the heat sink has a recess and wherein the carrier is partly or fully positioned within the recess.

2. A lighting module according to claim 1, wherein the carrier comprises a driver being electrically connected to the base and the light source.

3. A lighting module according to claim 1, wherein the connecting construction for connecting the light unit rotatably to the carrier comprises an integrated electrical connection for electrically connecting the driver to the light source.

4. A lighting module according to claim 1, wherein the light source comprises an optical element being positioned in the optical path of the light source and being configured for redirecting light of the light source wherein the optical element is selected from the group of: a reflective optical element, a diffractive optical element, a refractive optical element, or a scattering optical element.

5. A lighting module according to claim 1, wherein the connection construction connects the light unit to the carrier at a position on the longitudinal axis (LA).

6. A lighting module according to claim 1, wherein the connecting construction rotatably attaches a first end of the light unit, and further comprising an additional connecting construction that rotatably secures the light unit to the carrier at a location of the lighting unit distal from the first end, wherein at said location the carrier is cylindrically shaped.

7. A lighting module according to claim 1, wherein the connecting construction comprises a rotating mechanism for rotating around the carrier, the rotating mechanism comprises a first connector, the lighting unit comprises a second connector, the first connector and the second connecter being arranged for providing mechanical and electrical connection.

8. A lighting module according to claim 1, wherein the light unit comprises an active cooling device configured for removing thermal energy from the light source or the heat sink.

9. A lighting module according to any claim 1, wherein the carrier further comprises a further light source.

10. A luminaire comprising said lighting module according to claim 1.

11. A luminaire according to claim 10, further comprising a reflector and the lighting module having a radius extending in a direction perpendicular with respect to the longitudinal axis (LA) and having a distance D2 from the longitudinal axis (LA) to at least one edge of the lighting module, the reflector having a radius extending in a direction perpendicular with respect to the longitudinal axis (LA) and having a distance D3 from the longitudinal axis (LA) to the inner-side of the reflector, wherein at least at one point on the longitudinal axis (LA) the distance D2 is larger than the distance D3.

12. A luminaire according to claim 11, wherein the light unit is at least partly extending outside the reflector.

13. A method of installing a lighting module in a luminaire according to claim 11, the method comprising: rotatably connecting the base to the socket of the luminaire, and either: (i) whereby the light unit rotates with respect to the carrier to obtain a position of the light source, or (ii) mounting the light unit on the carrier in the direction towards the longitudinal axis (LA) using the connecting construction, wherein the light source has a predefined position with respect to the light exit of the reflector.

* * * * *